United States Patent [19]

Halverson

[11] Patent Number: 4,574,703

[45] Date of Patent: Mar. 11, 1986

[54] HIGH VELOCITY AMMUNITION SABOT

[75] Inventor: Henry J. Halverson, Collinsville, Ill.

[73] Assignee: Olin Corporation, Stamford, Conn.

[21] Appl. No.: 585,327

[22] Filed: Mar. 1, 1984

[51] Int. Cl.[4] ..... F42B 13/16

[52] U.S. Cl. ..... 102/520; 102/522

[58] Field of Search ..... 102/520–523, 102/532

[56] References Cited

U.S. PATENT DOCUMENTS

| | | | |
|---|---|---|---|
| 3,164,092 | 1/1965 | Reed et al. | 102/522 |
| 3,496,869 | 2/1970 | Engel | 102/522 |
| 4,148,259 | 4/1979 | Yuhash et al. | 102/522 |
| 4,187,271 | 2/1980 | Rolston et al. | 102/466 |
| 4,239,006 | 12/1980 | Kelson | 102/522 |
| 4,488,491 | 12/1984 | Rhodes | 102/522 |

*Primary Examiner*—Harold J. Tudor

*Attorney, Agent, or Firm*—Bruce E. Burdick

[57] ABSTRACT

A high velocity ammunition sabot of brittle material which has sufficient strength to withstand the forces of being launched from a rifled gun barrel but which fragments almost immediately upon exit from the barrel due to centrifugal forces. A polyetherimide material is preferred, although materials of equivalent properties could be used.

11 Claims, 2 Drawing Figures

HIGH VELOCITY AMMUNITION SABOT

BACKGROUND AND SUMMARY OF THE INVENTION

This invention relates to ammunition sabots and particularly to a disintegrating sabot.

"Small caliber" as used herein means 0.50" caliber and below. The state of the art in plastic small caliber sabots has basically remained static since the development of the plastic sabot for hunting ammunition shown in U.S. Pat. No. 3,164,092, issued Jan. 5, 1965, to D. S. Reed et al and assigned to Remington Arms Co., Inc. and which relates to the well-known Remington "Accelerator" hunting cartridge which uses a lead bullet in a polycarbonate sabot.

There is a constant desire to increase the speed, hardness, and density of lightweight subcaliber rifle bullets so that they will penetrate harder and thicker targets. However, it has not been known how to do this in conventional rifles due to the denser bullet materials that are required and the inability of existing sabots such as that taught by the Reed et al patent above to withstand the forces imposed by such launches of subcaliber projectiles having higher sectional density and hardness than the soft lead hunting bullets taught by the Reed et al patent.

The present invention provides a solution to this problem by providing an ammunition sabot which is strong enough to exit a rifled barrel in one piece at peak chamber pressures in excess of 70,000 copper crusher units of pressure (C.U.P.) while carrying a tungsten or tungsten carbide penetrator and then immediately disintegrate so that it doesn't thereafter slow down the projectile or make the projectile inaccurate. In the present invention, this is accomplished by use of a special sabot material and/or a special sabot design.

BRIEF DESCRIPTION OF THE DRAWINGS

The invention will be better understood by reference to the attached drawing in which.

DETAILED DESCRIPTION OF THE PREFERRED EMBODIMENTS

Figure 1:
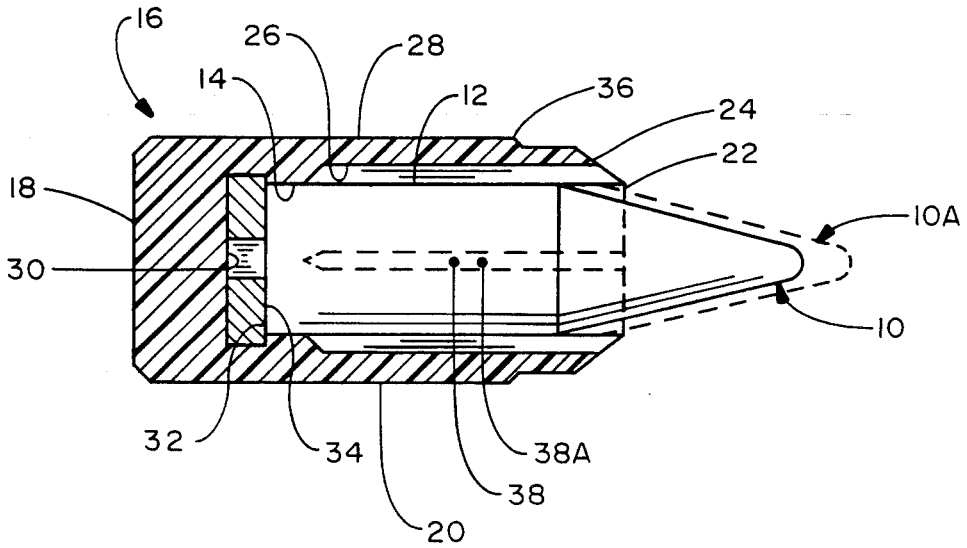
FIG. 1 is a cross-sectional view taken along the axis of a preferred sabot and projectile of the invention.

A projectile 10 is shown having a major cylindrical rear portion 12 carried with a central recess 14 of a generally cylindrical plastic sabot 16 which has a solid cylindrical rear base portion 18 and a tubular front portion 20. Front portion 20 comprises a plurality of arcuate cylindrical portions 22 connected by weakened portions 24 extending axially on portion 20. Weakened portions 24 are weakened by suitable means such as spaced axial grooves or notches 26 on the inner periphery of central recess 14. Notches 26 run from the front end of sabot 16 part way back on the inner periphery of front portion 20. The outer periphery 28 of sabot 16 is an uninterrupted right cylindrical surface.

Figure 2:
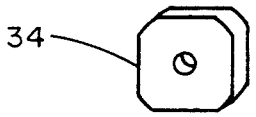
FIG. 2 is an isometric view of the washer of FIG. 1.

Between the floor 30 of recess 14 of sabot 16 and the rear end 32 of projectile 10 is a metallic square washer with rounded corners 34 (also shown in FIG. 2) which extends radially inward and outward of the inner periphery of central recess 14 so as to distribute the accelerational forces during explosive discharge of sabot 16 and projectile 10 together through a rifled gun barrel (not shown) and to prevent rotational slippage between sabot 16 and washer 34 during spin-up of sabot 16 during such discharge. Washer 34 could be of other non-circular symmetrical shapes such as polygonal, (pentagonal, or hexagonal, etc.), oval, or gear-shaped. Washer 34 has rounded corners to reduce stress concentrations at its corners and to allow use of bigger area washers.

Outer periphery of 28 of sabot 16 is of a substantially constant diameter from base 18 up to an axial point 36 which is located forward of the center of gravity 38 of projectile 10 to minimize balloting of projectile 10 during its passage through a rifled gun barrel, as might occur if point 36 was located back of center of gravity 38. A second optional heavy projectile **10*a* is also shown having a center of gravity 38*a*, which is also behind point 36**.

Sabot 16 is of 7.62 mm caliber and carries a 52 grain tungsten projectile 10 or a 57 grain tungsten projectile **10*a*. Other calibers of sabot 16 such as 5.56 mm or 0.50 caliber could also be utilized and other sizes, materials, and shapes of projectiles 10** could be utilized, if desired.

The plastic for sabot 16 is of a material that has sufficient tensile strength (at least 12,000 psi when tested under the standard ASTM Test Method D1708), compressive strength (at least 15,000 psi when tested under the standard ASTM Test Method D695), and sufficient shear strength (at least 12,000 psi when tested under standard ASTM Test Method D732) to withstand the shock of explosive discharge from a rifled gun barrel while carrying projectile 10 but having insufficient (less than about 12 ft.-lbs./in. when tested under standard ASTM Test Method D256) Izod impact strength to withstand centrifugal and aerodynamic forces following discharge so that sabot 16 disintegrates immediately (i.e., within a yard) after exiting the barrel muzzle, thus immediately freeing the projectile 10 for unimpeded flight to the target.

One suitable plastic material is "ULTEM 1000", an unreinforced amorphous polyetherimide thermoplastic resin marketed by General Electric Company. Some other plastics believed to be suitable are ULTEM 2200, a 20% glass reinforced polyetherimide resin and LEXAN 3412, a 20% glass reinforced polycarbonate resin, both from General Electric Company and TORLON 4203L engineering resin from Amoco Chemicals Corporation. Other plastics with equivalent mechanical properties could be utilized if the mechanical properties of the plastic are not chemically deteriorated by any exposure to propellants with which it is expected to be utilized.

I claim

1. A small caliber spin stabilized, frangible discarding sabot projectile comprising:

a hard metallic armor-penetrator subcaliber core; and a cylindrical sabot having a central recess in a front end thereof surrounding a rear portion of said penetrator and having a solid base portion behind said core, said sabot being made of a plastic material with an Izod impact strength of less than 12 ft. lbs./in. of notch when tested under ASTM Test Method D256, a compressive strength of at least 15,000 psi when tested under ASTM Test Method D695, a shear strength of at least 12,000 psi when tested under ASTM Test Method D732 and a tensile strength of at least 12,000 psi when tested under ASTM Test Method D1708.

2. The projectile of claim 1 wherein said sabot material is an amorphous polyetherimide resin thermoplastic.

3. The projectile of claim 1 wherein said sabot material is a polycarbonate thermoplastic resin reinforced with glass fibers.

4. The projectile of claim 1 wherein said sabot material is a polyetherimide reinforced with glass fibers.

5. The sabot of claim 1 further comprising a tubular frontal projection surrounding and receiving a major rear portion of said subcaliber core, wherein said projection comprises a plurality of arcuate cylindrical segments connected by weakened portions extending axially on said projection.

6. The sabot of claim 5 wherein said weakened portions are spaced axial grooves on the inner periphery of said projection, and the outer periphery of said sabot is uninterrupted, whereby said projection can assist in obturation of said barrel.

7. The sabot of claim 6, further comprising a plate having a flat planar front face facing toward the central cylindrical recess and having a substantially polyonal symmetrical perimeter whereby to prevent rotation of the plate relative to the sabot during spin-up of the sabot without the necessity for any longitudinal projections from the plate.

8. The sabot of claim 5, further comprising a plate having a flat planar front face facing toward the central cylindrical recess and having a substantially polyonal symmetrical perimeter whereby to prevent rotation of the plate relative to the sabot during spin-up of the sabot without the necessity for any longitudinal projections from the plate.

9. The sabot of claim 5 wherein said projection has the same outer diameter as the rear portion of said sabot at least up to the axial location of the axial center of gravity of said projectile so as to help prevent sabot balloting during discharge through the barrel.

10. The sabot of claim 1 wherein said sabot has a diameter less than 0.50 inches.

11. The sabot of claim 8 wherein said metallic plate is square with rounded corners.

* * * * *